US008366877B2

(12) United States Patent
Duggirala et al.

(10) Patent No.: US 8,366,877 B2
(45) Date of Patent: Feb. 5, 2013

(54) LIPOHYDROPHILIC GLYCEROL BASED POLYMERS AS DIGESTION AIDS FOR IMPROVING WOOD PULPING PROCESSES

(75) Inventors: Prasad Y. Duggirala, Naperville, IL (US); Xiaojin Harry Li, Palatine, IL (US)

(73) Assignee: Nalco Company, Naperville, IL (US)

( * ) Notice: Subject to any disclaimer, the term of this patent is extended or adjusted under 35 U.S.C. 154(b) by 131 days.

(21) Appl. No.: 12/720,973

(22) Filed: Mar. 10, 2010

(65) Prior Publication Data

US 2011/0220307 A1 Sep. 15, 2011

(51) Int. Cl.
*D21C 3/00* (2006.01)
*D21C 3/26* (2006.01)

(52) U.S. Cl. ..... 162/72; 162/75; 162/76

(58) Field of Classification Search ..... 162/72, 162/75, 76

See application file for complete search history.

(56) References Cited

U.S. PATENT DOCUMENTS

| | | | | |
|---|---|---|---|---|
| 2,023,388 | A | 12/1935 | Harris | |
| 3,637,774 | A | 1/1972 | Babayan et al. | |
| 5,032,224 | A * | 7/1991 | Ahluwalia | 162/75 |
| 5,198,532 | A | 3/1993 | Blytas et al. | |
| 5,429,718 | A * | 7/1995 | Morlino et al. | 162/72 |
| 5,728,265 | A | 3/1998 | Saint Victor et al. | |
| 6,228,416 | B1 | 5/2001 | Reibert et al. | |
| 6,765,082 | B2 | 7/2004 | Sunder et al. | |
| 6,770,168 | B1 * | 8/2004 | Stigsson | 162/24 |
| 7,081,183 | B2 | 7/2006 | Duggirala et al. | |
| 2006/0286052 | A1 | 12/2006 | Oki et al. | |
| 2008/0306211 | A1 | 12/2008 | Lemke et al. | |
| 2010/0292380 | A1 * | 11/2010 | Martin et al. | 524/314 |
| 2011/0092743 | A1 | 4/2011 | Li et al. | |

FOREIGN PATENT DOCUMENTS

| | | | |
|---|---|---|---|
| CA | 2613704 | A1 | 5/2005 |
| DE | 10307172 | A1 | 1/2007 |

OTHER PUBLICATIONS

Smook, Handbook for Pulp and Paper Technologists, 1992, Angus Wilde Publications, 2nd edition, chapter 4.*

* cited by examiner

*Primary Examiner* — Anthony Calandra
(74) *Attorney, Agent, or Firm* — Benjamin E. Carlsen; Andrew D. Sorensen

(57) ABSTRACT

The invention provides a method of improving the digestion of wood chips into pulp. The method involves: adding a liphohydrophilic glycerol-based polymer additive to a solution used in the digestion process. This additive is unexpectedly effective at facilitating digestion. The branched and ether structure of the additive allows it to withstand the harsh nature of a highly alkaline environment. In addition, it is more soluble in high pH than other surfactants. The structure, resistance, and particular balance between hydrophobic and hydrophilic regions, causes the additive to increases the interaction between the wood chips and the digestion chemicals. This in turn reduces the costs, the amount of additive needed, and the amount of reject wood chunks that result from the digestion process.

13 Claims, 5 Drawing Sheets

LIPOHYDROPHILIC GLYCEROL BASED POLYMERS AS DIGESTION AIDS FOR IMPROVING WOOD PULPING PROCESSES

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

This invention relates to compositions of matter and methods of digesting wood chips used in paper pulping processes. Digestion is a process in which cellulosic raw materials such as wood chips are treated with chemicals including alkaline and sulfide, usually at high pressure and temperature for the purpose of removing impurities and producing pulp suitable for papermaking. The mixture of chemicals is predominantly in a liquid form and is sometimes referred to as white liquor. Wood chips which consist primarily of cellulose, hemicellulose, lignin, and resins are broken down by digestion into a pulp of cellulose and hemicellulose fibers. The lignin and resins, which are undesirable in paper, are at least partially removed in the delignification stage of digestion.

The digestion process can be enhanced by the presence of one or more surfactants in the white liquor. The surfactants reduce the surface tension at the interface between the white liquor and the wood chips. This reduced surface tension allows the chemicals in the white liquor to penetrate more deeply into the wood chips and thereby better digest. Unfortunately the optimal composition of white liquor impairs the effectiveness of the surfactants. Because white liquor has a high pH, it causes most surfactants to salt out of solution especially in high temperatures and pressures. This reduces the amount of surfactant effective on the wood chips. Reducing the amount of surfactant causes wood chunks (known as rejects) to survive the digestion process which imposes additional costs and quality control issues in subsequent papermaking stages. Attempting to overcome this problem by supersaturating the white liquor with surfactant has been shown to offer little improvement and is undesirably expensive. Similarly, lowering the temperature, pressure, or pH of the white liquor, also results in more rejects surviving digestion.

Thus there is a clear need for, and utility in an improved method of digesting wood chips into paper pulp. The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. §1.56(a) exists.

BRIEF SUMMARY OF THE INVENTION

At least one embodiment of the invention is directed towards a method for enhancing the penetration of cooking liquor into wood chips. The method comprises cooking wood chips in a white liquor to form a paper pulp and including at least one additive, the additive comprising a lipohydrophilic glycerol-based polymer in the white liquor. The method enhances the penetration of pulping liquor into the chips and the like, and reduces lignin, extractives and rejects levels in the paper pulp.

The additive can be a lipohydrophilic polyglycerols. The additive can be selected from the list consisting of lipohydrophilic polyglycerols, polyglycerol derivatives, other lipohydrophilic glycerol-based polymers, and any combinations thereof. The lipohydrophilic glycerol-based polymers can be linear, branched, hyperbranched, dendritic, cyclic and any combinations thereof. The additive can be added to the white liquor in an amount of less than 1% based on the dried weight of the chips and/or 0.05 to 0.001% based on the dried weight of the chips. The additive's branched structure enhances the penetration of digestion chemicals into the wood chips. The amount of hydrophobic and hydrophilic regions can be balanced to enhance the penetration of digestion chemicals into the wood chips. The additive can reduce the amount of lignin in the produced paper pulp by at least 0.5%. The digestion process can be one selected from the list consisting of Kraft digestion, sulfite cooking digestion, mechanical digestion, and for pulps designed for conversion into synthetic fibers such as dissolving grade pulps. The white liquor also may comprise additional surfactant(s). The lipohydrophilic glycerol based polymers can be used by combining with anthraquinone, anthraquinone derivatives, quinone derivatives, polysulfide and the like and any combinations thereof.

BRIEF DESCRIPTION OF THE DRAWINGS

A detailed description of the invention is hereafter described with specific reference being made to the drawings in which.

DETAILED DESCRIPTION OF THE INVENTION

Definitions

Figure 1:
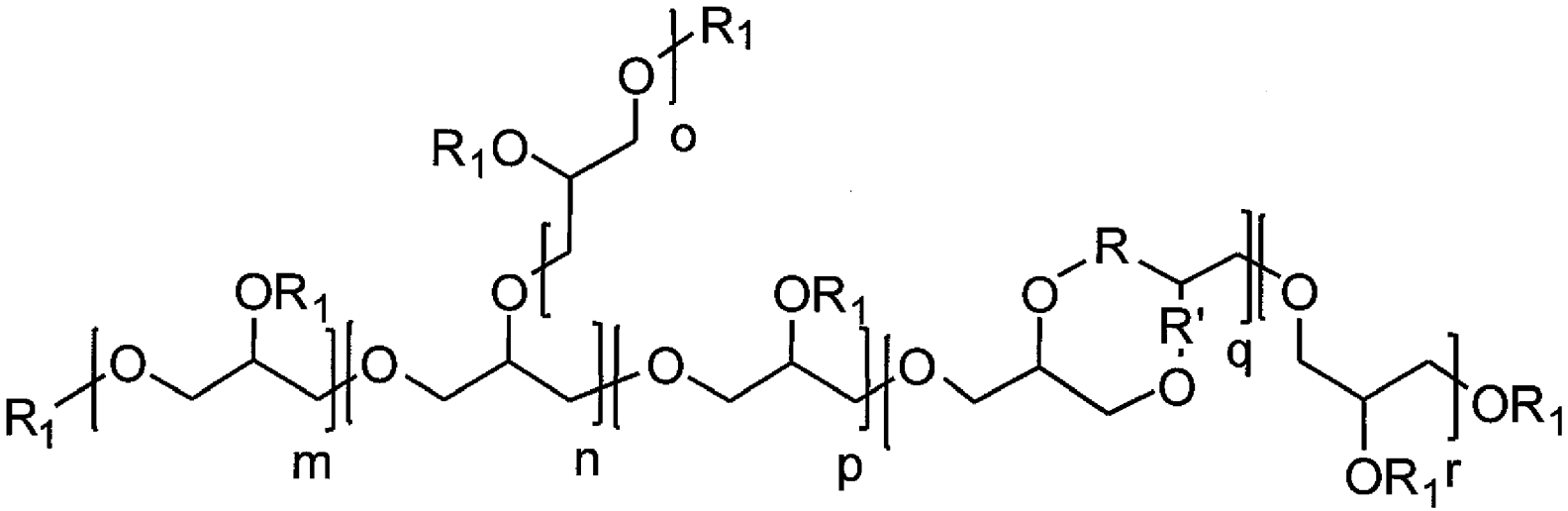
FIG. 1 is an illustration of lipohydrophilic glycerol-based polymer
Figure 2:
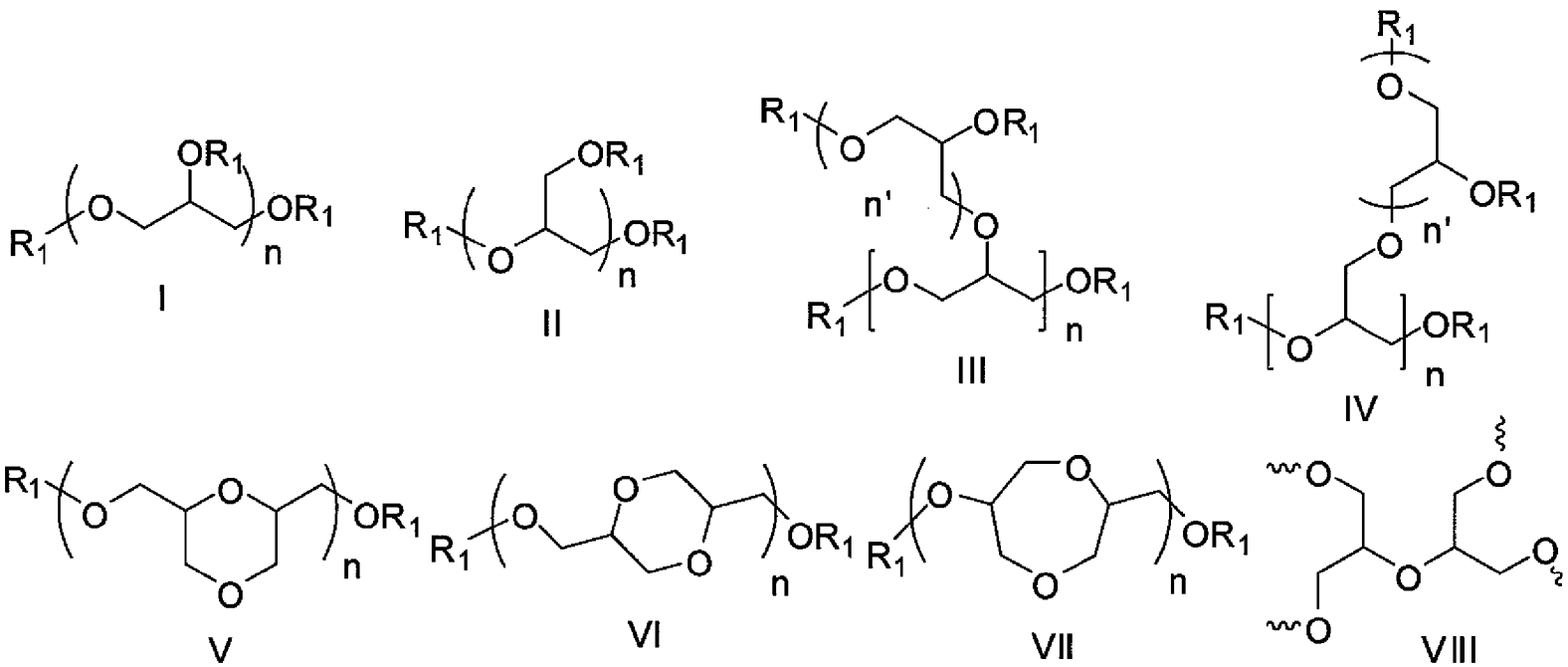
FIG. 2 is an illustration of basic structural units
Figure 3:
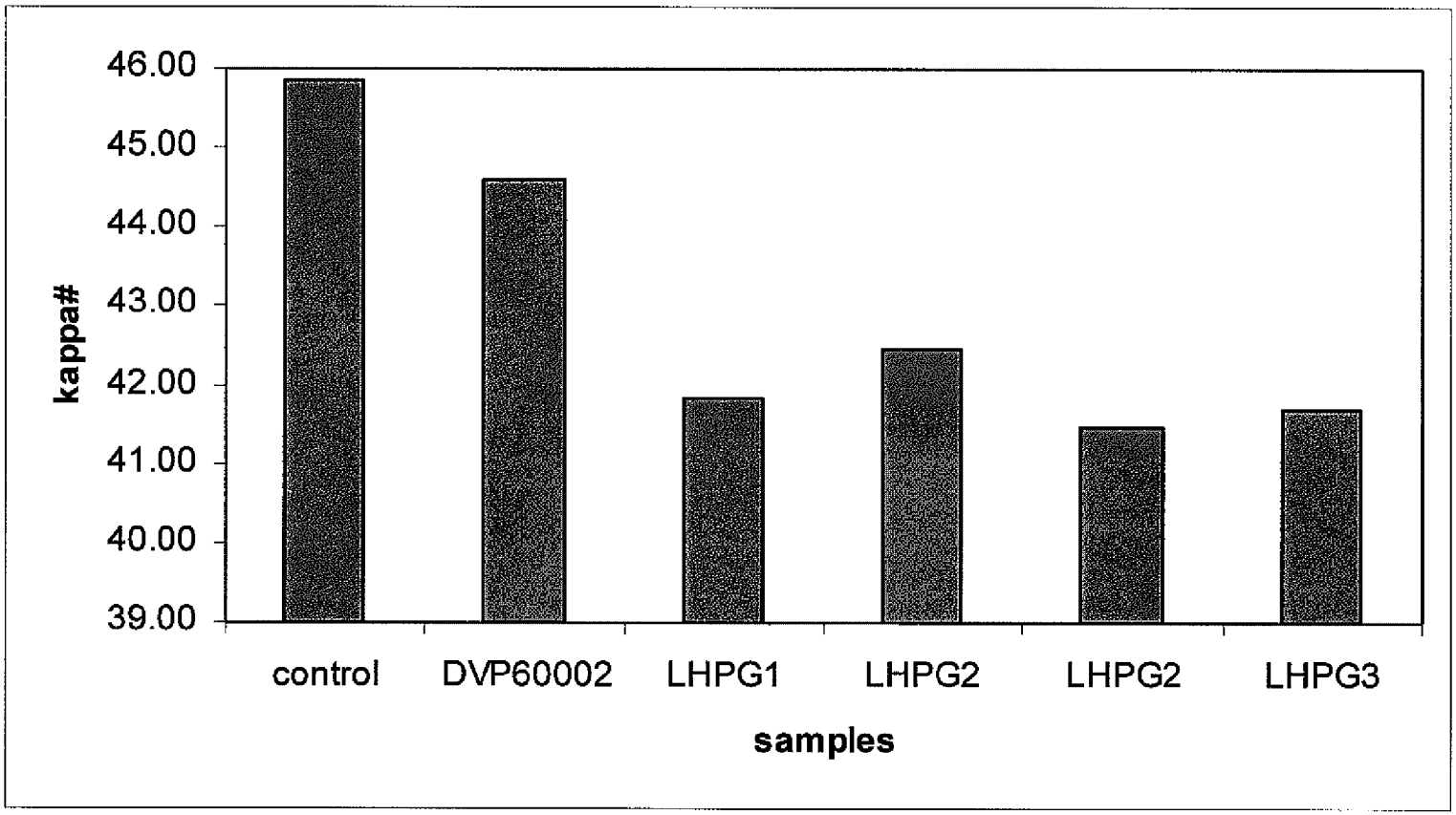
FIG. 3 is the kappa numbers of aged wood chip digestion
Figure 4:
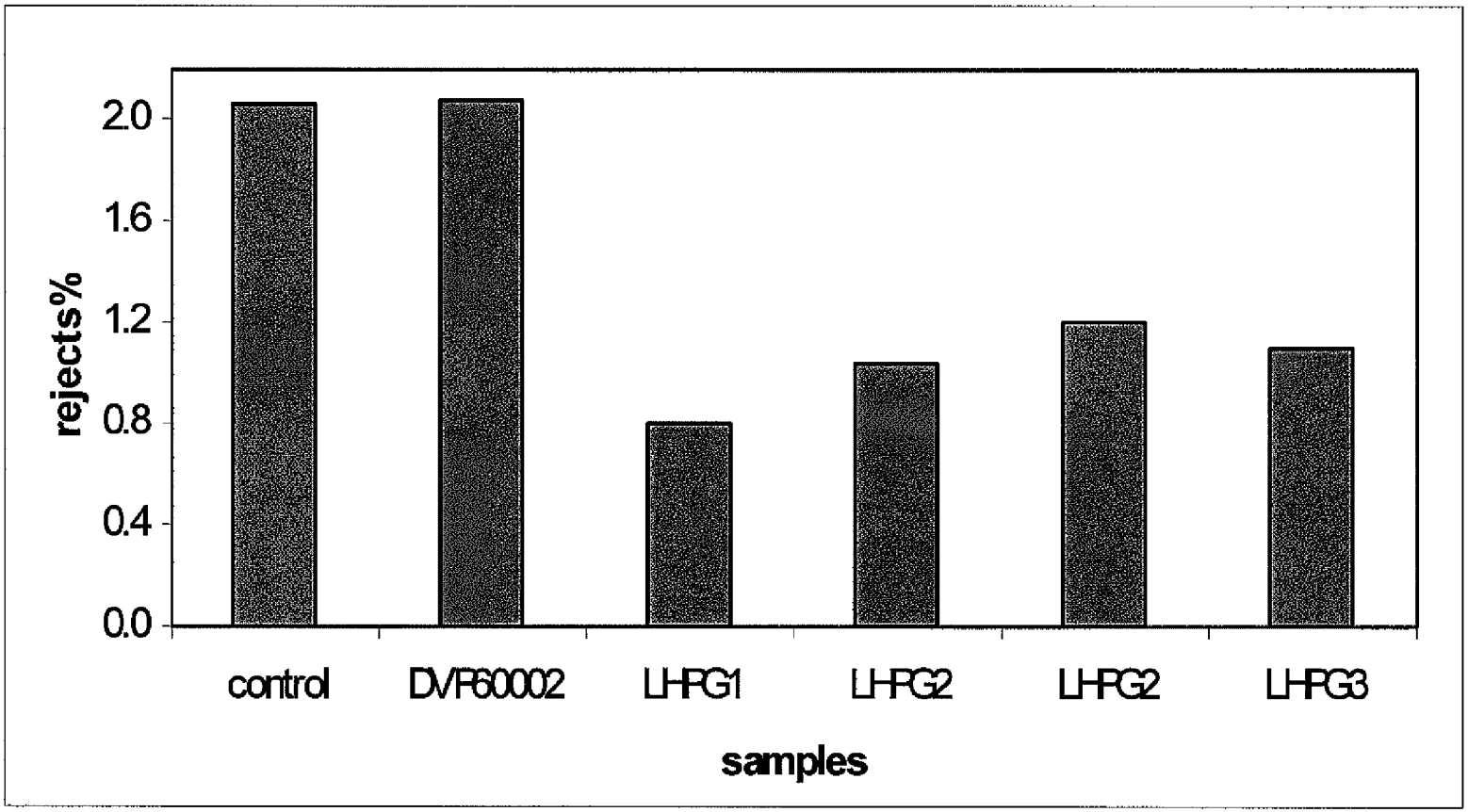
FIG. 4 is the rejects from the aged wood chip digestion
Figure 5:
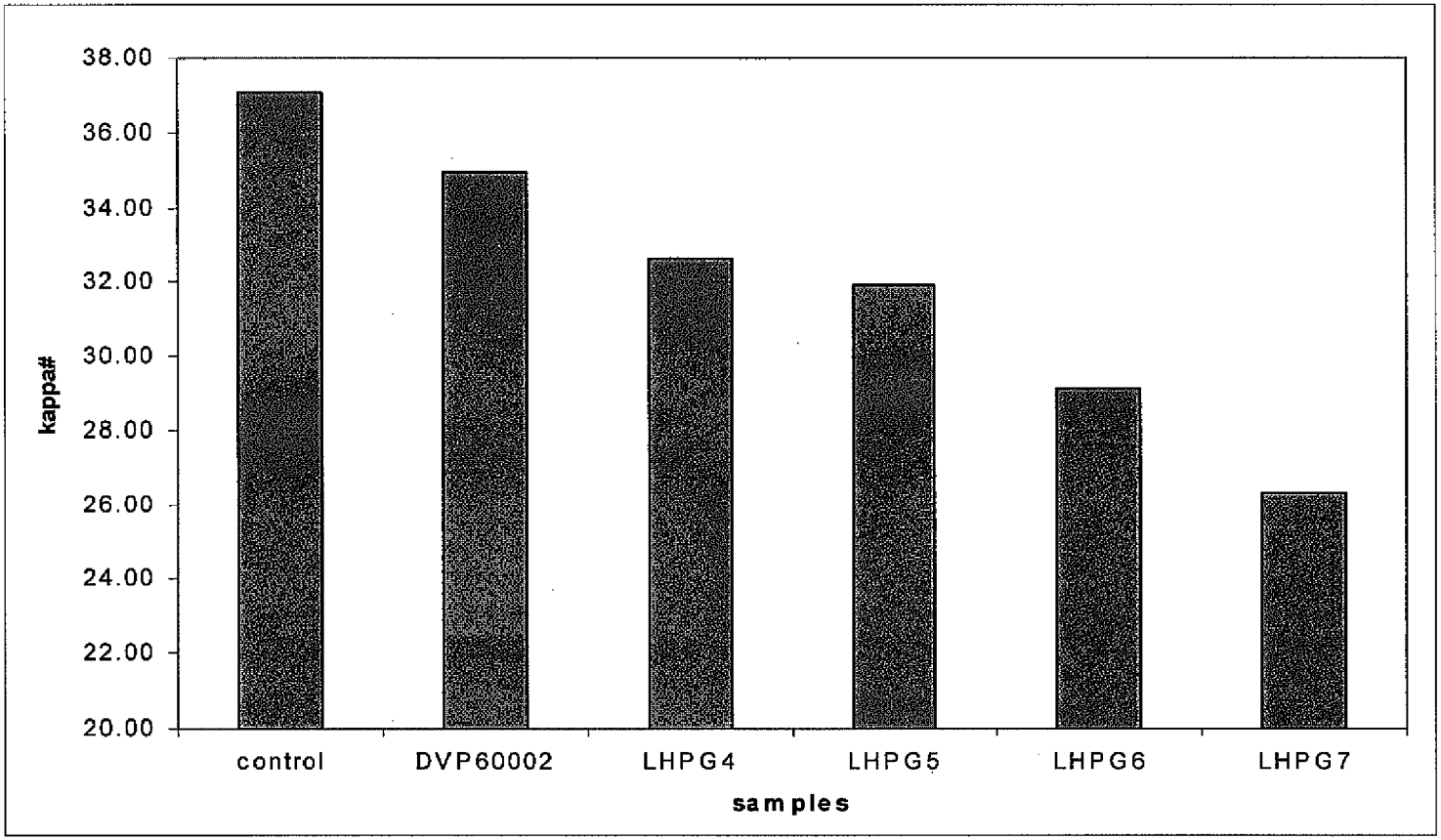
FIG. 5 is the kappa numbers of fresh wood chip digestion

For purposes of this application the definition of these terms is as follows:

"Alkoxylate group" means the single bonded carbon and oxygen bearing group engaged to a glycerol monomer in a glycerol-based polyoxyalkylene polymer, as described in U.S. Pat. No. 5,728,265.

"Branched" means a polymer having branch points that connect three or more chain segments. The degree of branching may be determined by $^{13}C$ NMR based on known literature method described in *Macromolecules,* 1999, 32, 4240.

"Cyclic" means a polymer having cyclic or ring structures. The cyclic structure units can be formed by intramolecular cyclization or any other ways to incorporate.

"Extractives" means wood extractives consisting of resin acids, fatty acids, sterols and sterol esters.

"Interface" means the surface forming a boundary between the phase of wood chips and the phase of liquor undergoing digestion. Surfactants facilitate the delivery of digestion chemicals to the interface.

"Glycerol-based polymers" means any polymers containing repeating glycerol monomer units such as polyglycerols, polyglycerol derivatives, and a polymer consisting of glycerol monomer units and at least another monomer units to other multiple monomers units regardless of the sequence of monomers unit arrangements.

"Hyperbranched" means a polymer, which is highly branched with three-dimensional tree-like structures or dendritic architecture.

"Kappa number" means a measurement of the degree of delignification that occurred during digestion as determined according to the principles and methodology defined in the scientific paper: *Kappa Variability Roundtable: Kappa Measurement,* 1993 *Pulping Conference Proceedings*, by Fuller W. S., (1993), TAPPI Technical Paper.

"Lipohydrophilic glycerol-based polymers" means glycerol-based polymers having lipophilic and hydrophilic functionalities, for example, lipohydrophilic polyglycerols resulting from lipophilic modification of polyglycerols (hydrophilic) in which at least a part of and up to all of the lipophilic character of the polymer results from a lipophilic carbon bearing group engaged to the polymer but not being an alkoxylate group, the lipophilic modification being one such as alkylation, and esterification modifications.

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference. In light of the above, in the event that a term can only be understood if it is construed by a dictionary, if the term is defined by the *Kirk-Othmer Encyclopedia of Chemical Technology,* 5th Edition, (2005), (Published by Wiley, John & Sons, Inc.) this definition shall control how the term is to be defined in the claims.

Recital

In at least one embodiment, an additive is added to the white liquor of a wood chip digestion process, which improves the pulp yield. The additive comprises an effective amount of a lipohydrophilic polyglycerols solution. The solution is compatible and stable both in high temperatures and when in the presence of a highly alkaline environment. The additive solution can be used in a number of digestion processes including Kraft digestion, sulfite pulping, mechanical pulping and for pulps designed for conversion into synthetic fibers (such as dissolving grade pulps).

In at least one embodiment, the lipohydrophilic glycerol-based polymers are produced from polyglycerols according to known prior arts such as alkylation of polyols as described in German patent application DE 10,307,172 A1, in Canadian patent CA 2,613,704 A1, in U.S. Pat. No. 6,228,416 and in a scientific paper of Polymer International, 2003, 52, 1600-1604 and the like.

In at least one embodiment the lipohydrophilic glycerol-based polymers are produced according to known prior arts such as esterificaton of glycerol-based polyols as described in U.S. Pat. No. 2,023,388, US published patent application 2006/0286052 A1 and the like. The esterification may be carried out with or without a catalyst such as acid(s) or base(s).

In at least one embodiment, the lipohydrophilic glycerol-based polymers are produced according to known prior arts such as alkylation, esterificaiton and any combinations thereof.

In at least one embodiment, glycerol-based polymers used to produce the corresponding lipohydrophilic polymers are from commercially available suppliers, from syntheses according to known prior arts such as described in U.S. Pat. Nos. 3,637,774, 5,198,532 and 6,765,082 B2, US published patent application 2008/0306211 A1 and U.S. patent application Ser. No. 12/582,827, or from any combinations thereof.

Without being limited to theory it is believed that one advantage of using lipohydrophilic glycerol based polymers that it has a particularly advantageous balance between hydrophilic and hydrophobic regions, which are especially suited to the surface region of wood chips in a white liquor environment. This balance allows the additive to occupy just the right position relative to the wood chip surface and deliver greater amounts of digestion chemicals to the wood chips than other less balanced surfactants can.

Glycerol based polymers having both lipophilic and hydrophilic portions are not in and of themselves new. They are at least somewhat mentioned in the polyoxyalkylene polymers described in U.S. Pat. No. 5,728,265. In these prior art polymers an alkyl group is located on an alkoxylate group stemming from one of the polyglycerols monomers. In the instant invention however the lipophilic character of the polymer results from a lipophilic carbon bearing group engaged to the polymer but not being located on an alkoxylate group. As the subsequent data shows, this results in unexpectedly superior results.

In addition, the branched nature and the resulting 3-dimensional distribution of the particular regions of the lipohydrophilic glycerol-based polymers both allows them to better reside at the interface and to better deliver digestion chemicals to the wood chips.

In at least one embodiment, the digestion aid is lipohydrophilic glycerol-based polymers, including lipohydrophilic polyglycerols, lipohydrophilic polyglycerol derivatives, and other lipohydrophilic glycerol-based polymers consisting at least one glycerol monomer unit and at least another to multiple monomers units regardless of the arrangements of monomers units.

In at least one embodiment, the lipohydrophilic glycerol-based polymers can be linear, branched, hyperbranched, dendritic, cyclic and any combinations thereof.

In at least one embodiment, lipohydrophilic glycerol-based polymer has the basic structure illustrated in FIG. 1. According to this structure, m, n, o, p, q, and r, are independently any number of 0 and integers of between 1-700, and R and R' are $(CH_2)_n$ and n can independently be 1 or 0 each. In FIG. 1 each R1 is independently H or a C1-C40 functional group but at least one R1 is not H. R1 can be saturated, unsaturated, linear, branched, hyperbranched, dendritic, cyclic and any combinations thereof.

In at least one embodiment, the lipohydrophilic glycerol-based polymers can be produced from glycerol-based polyols according to known prior arts by alkylation, esterification and any combinations thereof.

In at least one embodiment, polyglycerols used to produce lipohydrophilic polyglycerols are from commercially available sources, syntheses according to known prior arts as described above or any combinations thereof.

In at least one embodiment, the additive reduces the surface tension at the wood chip-white liquor interface substantially while it is within a dosage of only 0.005-0.008 weight % of additive relative to the weight of the wood chips.

In at least one embodiment, the additive lowers the surface tension of water from 71.9 Nm/g (in the absence of any additive) to 23.5-26.8 Nm/g.

In at least one embodiment the additive solution reduces the kappa number of the resulting pulp.

In at least one embodiment, the amount of additive needed is far less than of comparable surfactants as described in U.S. Pat. No. 7,081,183.

In at least one embodiment, the additive improves reduced rejects level from 26 to 62% in comparison with prior surfactants as described in U.S. Pat. No. 7,081,183.

In at least one embodiment, the additive can be used with other additives such as anthraquinone, anthraquinone derivatives, quinone derivatives, polysulfide and the like.

In at least one embodiment, the additive is an effective aid for deresination and delignification in improving wood chip cooking processes.

EXAMPLES

The foregoing may be better understood by reference to the following Examples, which are presented for purposes of illustration and are not intended to limit the scope of the invention:

Example 1

Lipohydrophilic Glycerol-Based Polymers

The lipohydrophilic glycerol-based polymers are synthesized from glycerol-based polyols according to known prior arts described in the recital section:

TABLE 1

Glycerol-based Polyols Used for Syntheses of the Lipohydrophilic Polymers*

| LHPG samples | Gycerol-based polyols used | MW | Sources |
|---|---|---|---|
| LHPG1 | PG1 | 4,400 | synthesis |
| LHPG2 | PG2 | 6,100 | synthesis |
| LHPG3 | PG3 | 4,000 | synthesis |
| LHPG4 | PG4 | 7,800 | synthesis |
| LHPG5 | PG5 | 590 | Sakamoto Yakuhin Kogyo Co., Ltd |
| LHPG6 | PG6 | 3,800 | synthesis |
| LHPG7 | PG7 | 7,300 | synthesis |

*LHPG-lipohydrophilic polyglycerol; PG-polyglycerol.

Example 2

Solubility Test

Diluted samples (1:20 dilution) were added to 23.5 mL of 10% NaOH solution that was pre-heated for 15 minutes in water bath at 80° C. Samples were added at three doses 0.025, 0.050 and 0.100 mL based on product. The solubility was checked right after the addition. Then samples were heated for additional 15 minutes in the water bath at 80° C. and again checked for the solubility. In addition, the solubility after samples cooled down was checked too. The solubility was ranked based on the clarity of vision observation for tested samples.

Example 3

Surface Tension

Surface tension was measured with Kruss—K12 processor tensiometer. All samples were tested at 0.5% consistency.

Example 4

Kappa Number and Rejects

Aged and fresh softwood chips from a midwestern mill were used. Cooking experiments were performed on 20 g of wood at 4:1 liquor to wood ratio, with 15% alkali and 25% sulfidity charge. The alkali was sourced from sodium hydroxide (70%) and sodium sulfide (30%). Weak black liquor (~20% solids) was used to makeup liquid. Digester additives (lipohydrophilic glycerol-based polymers) were added to the black liquor, which was mixed well and then combined with the white liquor. All cooks began at 55° C. and the temperature was quickly ramped to 170° C., for a total cooking time of 3 hours. After that, the cooking capsules were placed under cold miming water for approximately 10 minutes. The contents were then transferred to cheesecloth and squeezed under warm water to remove the majority of cooking liquor. The pulp was then diluted with warm tap water to 800 mL and disintegrated in Waring blender for 30 seconds. The resulting slurry was transferred to cheesecloth and washed three times with 800 mL of warm tap water. The pulp was broken down by hand into small pieces and all rejects were removed. The resulting pulp was oven dried overnight and weighted. The pulp was allowed to dry in the CTH room for 4 days to an average consistency of 92%. Kappa numbers were determined using TAPPI test method T 236.

Samples were prepared of lipohydrophilic polyglycerols and were compared with a prior art alkyl polyethylene glycol surfactant (DVP6000) described in U.S. Pat. No. 7,081,183B2, and a control sample having no surfactant at all.

Table 2 compares the solubility of the lipohydrophilic polyglycerol and the prior art surfactant. The data demonstrates that in high pH environments, the lipohydrophilic polyglycerols are more soluble and therefore for an equal amount of added surfactant, the inventive additive provides more surfactant at the interface.

TABLE 2

Solubility Test*

| Additive | Product Dosage (%) | Rank after addition at 80° C. | Rank after heating for 15 min at 80° C. | Rank after cooling down |
|---|---|---|---|---|
| DVP6000 | 0.025 | 1.5 | 1.5 | 1.5 |
| DVP6000 | 0.050 | 2.5 | 2.5 | 2 |
| DVP6000 | 0.100 | 4 | 4 | 3 |
| LHPG1 | 0.025 | 1 | 1 | 1 |
| LHPG1 | 0.050 | 1 | 1 | 1 |
| LHPG1 | 0.100 | 1 | 1 | 1 |
| LHPG2 | 0.025 | 1 | 1 | 1 |
| LHPG2 | 0.050 | 1.5 | 1 | 1.5 |

*The concentration of products used: DVP6000 in 16%, LHPG1 in 50% and LHPG2 in 50%; Ranking: 1 = most soluble and 5 = least soluble Table 3 compares the surface tension of lipohydrophilic polyglycerols and a prior art surfactant. The lipohydrophilic polyglycerols low the surface tension of water dramatically and the surface tension of LHPGs is significantly lower than the prior art surfactant.

TABLE 3

| Surface Tension | |
|---|---|
| Examples | nN/m |
| DI water | 71.9 |
| DVP6002 | 35.4 |
| LHPG1 | 24.2 |
| LHPG2 | 25.1 |
| LHPG3 | 26.8 |

Digestion performance of various lipohydrophilic polyglycerols with aged and fresh wood chips are evaluated, and listed in Table 4 and Table 5. The data makes clear that the inventive liphohydrophilic polyglycerols provide lower kappa#s than prior art surfactants, even when used in much lower dosages. In particular it is noted that the prior art provided only 3 and 6% improvements on average over the control while the inventive formulations on average resulted in 9 and 19% improvements at a wide variety of dosages with aged and fresh wood chips, respectively. Furthermore, the lipohydrophilic polyglycerols reduce the rejects from the wood chip digestion on average over 47%, while the prior art surfactant has no improvement on the reduction of cooking rejects (Table 4).

TABLE 4

| Digestion Performance of Aged Wood Chips | | | |
|---|---|---|---|
| Examples | surfactants wt % | kappa# | rejects wt % |
| control | No | 45.84 | 2.1 |
| DVP60002 | 0.025% | 44.61 | 2.1 |
| LHPG1 | 0.0125% | 41.84 | 0.8 |
| LHPG2 | 0.0050% | 42.48 | 1.0 |
| LHPG2 | 0.00625% | 41.45 | 1.2 |
| LHPG3 | 0.0125% | 41.70 | 1.1 |

TABLE 5

| Digestion Performance of Fresh Wood Chips | | |
|---|---|---|
| Examples | surfactants wt % | kappa# |
| control | no | 37.07 |
| DVP60002 | 0.025% | 34.93 |
| LHPG4 | 0.008% | 32.63 |
| LHPG5 | 0.008% | 31.91 |
| LHPG6 | 0.006% | 29.12 |
| LHPG7 | 0.008% | 26.34 |

While this invention may be embodied in many different forms, there are shown in the drawings and described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some or all of the various embodiments described herein and incorporated herein.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), end ending with a maximum value of 10 or less, (e.g. 2.3 to 9.4, 3 to 8, 4 to 7), and finally to each number 1, 2, 3, 4, 5, 6, 7, 8, 9, and 10 contained within the range.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

This completes the description of the preferred and alternate embodiments of the invention. Those skilled in the art may recognize other equivalents to the specific embodiment described herein which equivalents are intended to be encompassed by the claims attached hereto.

What is claimed is:

1. A method for enhancing the penetration of cooking liquor into wood chips, the method comprising cooking wood chips in a white liquor to form a paper pulp and including at least one lipohydrophilic glycerol-based polymer additive in the white liquor, wherein the polymer has a branched structure, the branched structure characterized as having at least three chain segments of the polymer joined at a single joining monomer of the polymer which has an alkoxylate group, and in which at least one of the chain segments comprises a lipophilic carbon bearing group and this chain segment is engaged to the joining monomer at a location other than the alkoxylate group of the joining monomer, the method so enhances the penetration of pulping liquor into the chips that it reduces lignin such that the resulting pulp has a lower kappa number than if no polymer or if equal amounts of other glycerol based polymers were added to the liquor.

2. The method of claim 1 wherein the additive is lipohydrophilic glycerol-based polymer having branched and cyclic structures according to the structure:

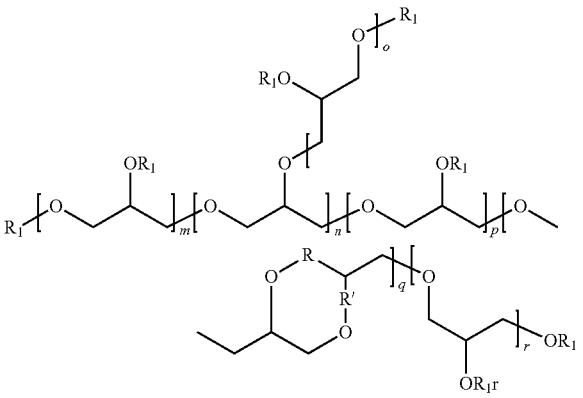

wherein m, n, o, and p are each independently between 1 and 700 and q and r is independently a number of 0 and integers of between 1-700, R and R' are $(CH_2)_n$ and n can independently be 1 or 0, and each R1 is independently H or a C1-C40 functional group but at least one R1 is not H.

3. The method of claim 1 wherein the additive is lipohydrophilic polyglycerols.

4. The method of claim 1 wherein the additive is selected from the list of lipohydrophilic polyglycerols, polyglycerol derivatives, and other lipohydrophilic glycerol-based polymers and any combinations thereof.

5. The method of claim 1 wherein the additive, lipohydrophilic glycerol-based polymers, are hyperbranched, dendritic, cyclic and any combinations thereof.

6. The method of claim 1 wherein the additive is added to the white liquor in an amount of less than 1% based on the dried weight of the chips.

7. The method of claim 1 wherein the additive is added to the white liquor in an amount of 0.05 to 0.001% based on the dried weight of the chips.

8. The method of claim 1 in which the polymer so enhances the penetration of pulping liquor into the chips that it reduces the extractives and rejects levels in the paper pulp lower than those present if another glycerol based polymer were used or if no polymer were added to the liquor.

9. The method of claim 1 in which the balance between hydrophobic and hydrophilic regions on the additive enhances the penetration of digestion chemicals into the wood chips.

10. The method of claim 1 in which the additive reduces the amount of lignin in the produced paper pulp by at least at least 0.5%.

11. The method of claim 1 in which the white liquor also may comprise additional surfactant(s).

12. The method of claim 1 in which the lipohydrophilic glycerol-based polymers can be used by combining with anthraquinone, anthraquinone derivatives, quinone derivatives, polysulfide and the like and any combinations thereof.

13. A method for enhancing the penetration of cooking liquor into wood chips undergoing a digestion process the method comprising cooking wood chips in a liquor to form a paper pulp and including at least one lipohydrophilic glycerol-based polymer additive in the liquor, wherein the polymer has a branched structure, the branched structure characterized as having at least three chain segments of the polymer joined at a single joining monomer of the polymer which has an alkoxylate group, and in which at least one of the chain segments comprises a lipophilic carbon bearing group and this chain segment is engaged to the joining monomer at a location other than the alkoxylate group of the joining monomer, the method so enhances the penetration of pulping liquor into the chips that it reduces lignin such that the resulting pulp has a lower kappa number than if no polymer or if equal amounts of other glycerol based polymers were added to the liquor, the digestion process is one selected from the list consisting of: sulfite cooking digestion and mechanical digestion.

* * * * *